US011208845B2

(12) United States Patent
Trujillo

(10) Patent No.: US 11,208,845 B2
(45) Date of Patent: Dec. 28, 2021

(54) LADDER ANCHORING ASSEMBLY

(71) Applicant: Leroy Trujillo, Arvada, CO (US)

(72) Inventor: Leroy Trujillo, Arvada, CO (US)

( * ) Notice: Subject to any disclaimer, the term of this patent is extended or adjusted under 35 U.S.C. 154(b) by 120 days.

(21) Appl. No.: 16/682,039

(22) Filed: Nov. 13, 2019

(65) Prior Publication Data

US 2021/0140236 A1 May 13, 2021

(51) Int. Cl.
*E06C 7/46* (2006.01)

(52) U.S. Cl.
CPC ..... *E06C 7/46* (2013.01)

(58) Field of Classification Search
CPC ..... E06C 7/46
See application file for complete search history.

(56) References Cited

U.S. PATENT DOCUMENTS

| | | | | |
|---|---|---|---|---|
| 776,446 | A | 11/1904 | Williamson | |
| 2,008,582 | A | 7/1935 | Fredrikson | |
| 3,012,628 | A | 12/1961 | Zumbaum | |
| 3,456,757 | A * | 7/1969 | Sain | E06C 7/46 182/111 |
| 4,153,137 | A * | 5/1979 | Johnson | E06C 7/42 114/362 |
| 4,576,250 | A | 3/1986 | Marish | |
| 5,078,231 | A | 1/1992 | Davis | |
| 5,337,856 | A | 8/1994 | Fillers | |
| 5,417,302 | A * | 5/1995 | McElfresh | E06C 7/42 182/108 |
| 5,421,429 | A | 6/1995 | Evans | |
| 6,167,989 | B1 | 1/2001 | Jung | |
| 6,328,330 | B1 * | 12/2001 | Haaser | B62B 1/20 182/21 |
| D474,284 | S | 5/2003 | Spencer | |
| 2007/0284190 | A1 * | 12/2007 | Chady | E06C 7/46 182/107 |
| 2012/0199416 | A1 * | 8/2012 | Hopkins | E06C 7/42 182/111 |

FOREIGN PATENT DOCUMENTS

| | | | | |
|---|---|---|---|---|
| DE | 202013011456 U1 * | 3/2014 | | E06C 7/46 |
| FR | 3043427 A1 * | 5/2017 | | A47B 91/12 |

* cited by examiner

*Primary Examiner* — Alvin C Chin-Shue

(57) ABSTRACT

A ladder anchoring assembly includes a first mount that has a first space for insertably receiving a foot of a ladder and a first engagement for engaging the foot of the ladder. The first mount is attachable to a support surface upon which the foot of the ladder is positioned. A second mount is included that has a second space therein for insertably receiving the foot of the ladder and a second engagement for engaging the foot of the ladder. The second mount is attachable to the support surface having the second mount being directed toward the first mount. Thus, each of the first mount and the second mount surrounds the foot of ladder. In this way the first mount and the second mount restrain the foot of the ladder on the support surface.

6 Claims, 6 Drawing Sheets

LADDER ANCHORING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to anchoring devices and more particularly pertains to a new anchoring device for anchoring feet of a ladder to a support surface.

(2) Description of Related Art Including Information Disclosed Under 37 CFR 1.97 and 1.98

The prior art relates to anchoring devices. The prior art discloses a variety of anchors that engage a top side of feet of a ladder. In each case the prior art discloses a single, unitary structure that engages the feet. Additionally, the prior art discloses fasteners that are integrated into the anchors for engaging the support surface on which the ladder is positioned. Generally speaking, the prior art discloses a structure that engages the foot of the ladder thereby inhibiting the foot of the ladder from sliding rearwardly. The prior art also discloses a restraint that engages rungs on the ladder or sides of the ladder.

BRIEF SUMMARY OF THE INVENTION

An embodiment of the disclosure meets the needs presented above by generally comprising a first mount that has a first space for insertably receiving a foot of a ladder and a first engagement for engaging the foot of the ladder. The first mount is attachable to a support surface upon which the foot of the ladder is positioned. A second mount is included that has a second space therein for insertably receiving the foot of the ladder and a second engagement for engaging the foot of the ladder. The second mount is attachable to the support surface having the second mount being directed toward the first mount. Thus, each of the first mount and the second mount surrounds the foot of ladder. In this way the first mount and the second mount restrain the foot of the ladder on the support surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
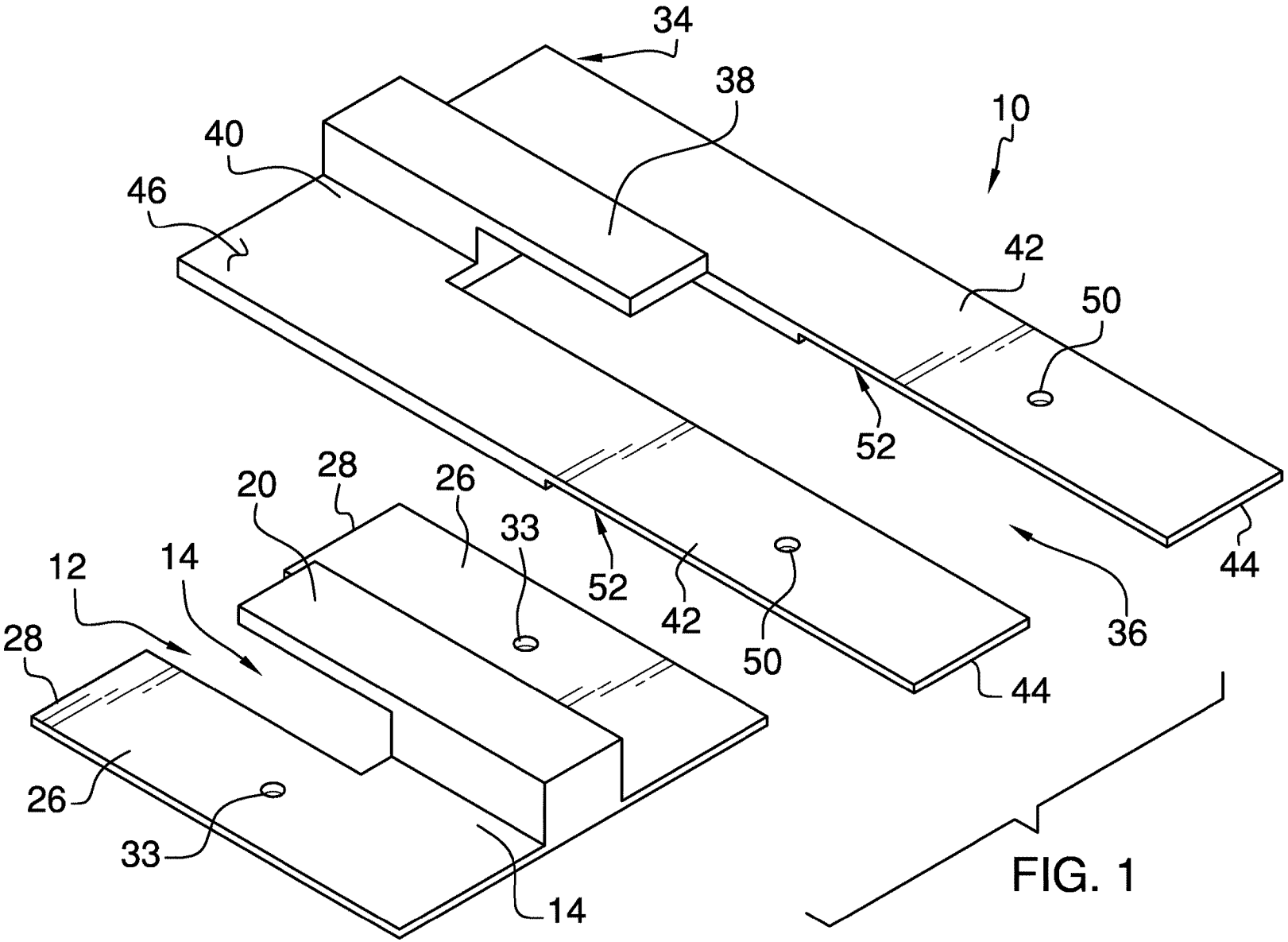
FIG. 1 is a perspective view of a ladder anchoring assembly according to an embodiment of the disclosure.
Figure 2:
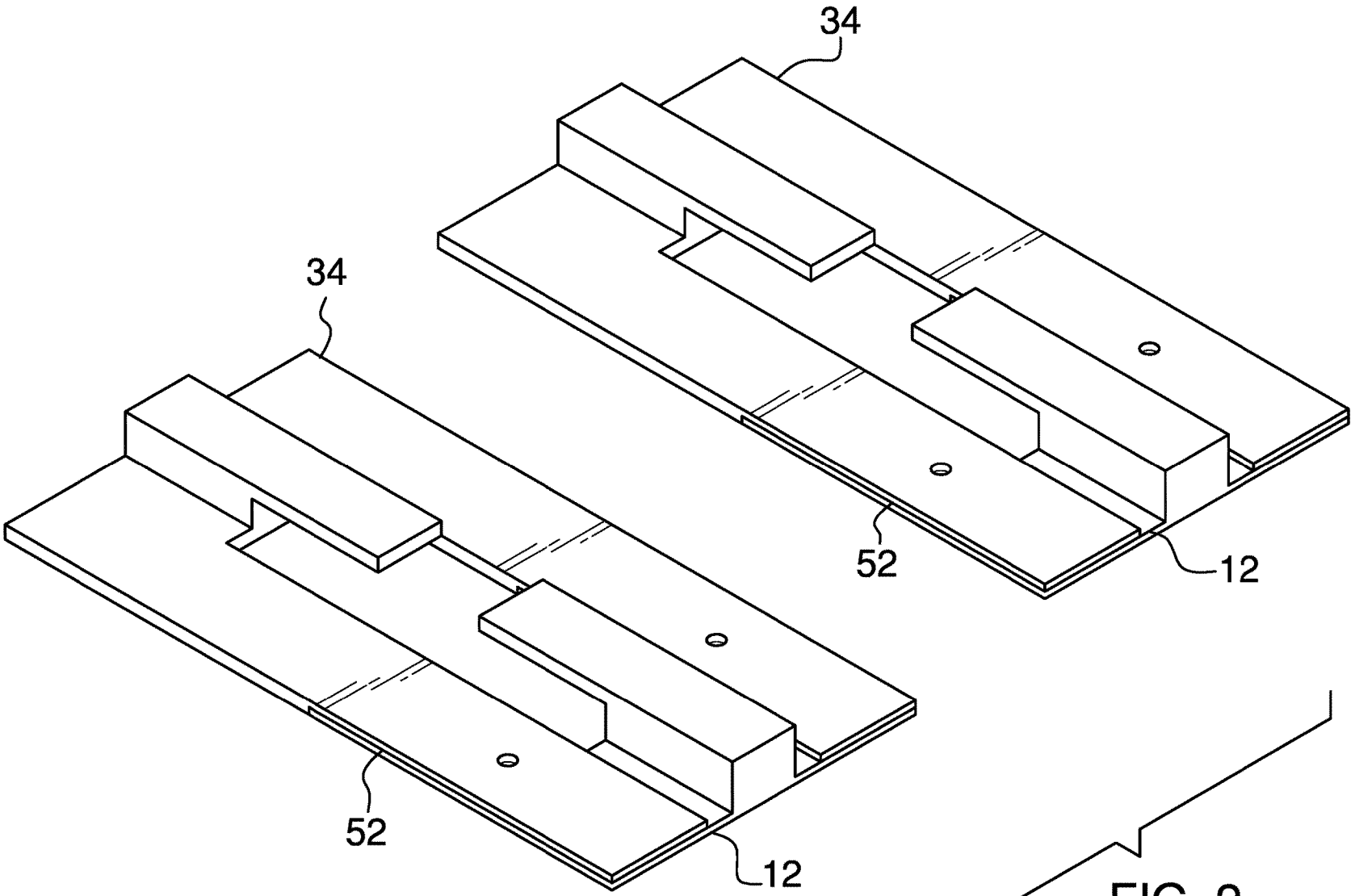
FIG. 2 is a perspective view of an embodiment of the disclosure showing a pair of first mounts each being engaged with a respective one of a pair of second mounts.
Figure 3:
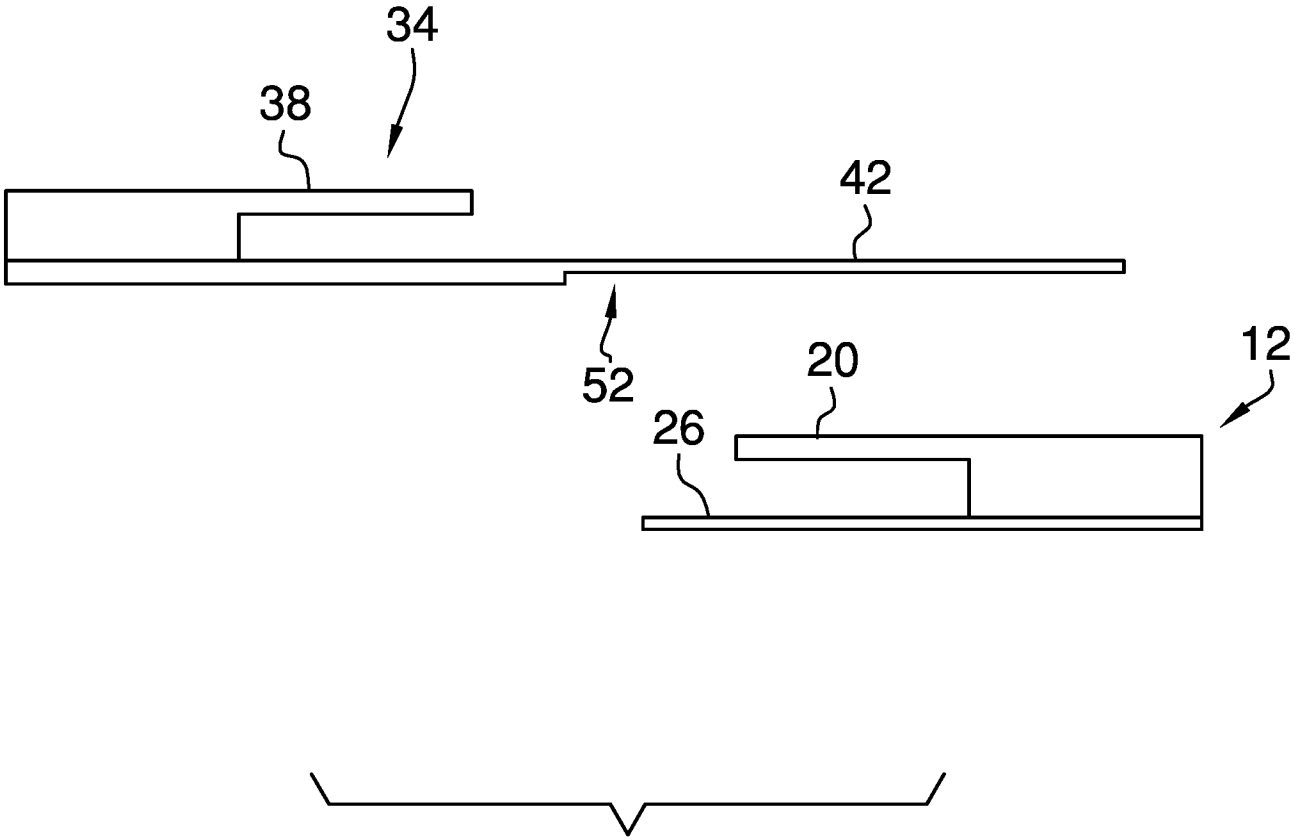
FIG. 3 is a right side view of an embodiment of the disclosure.
Figure 4:
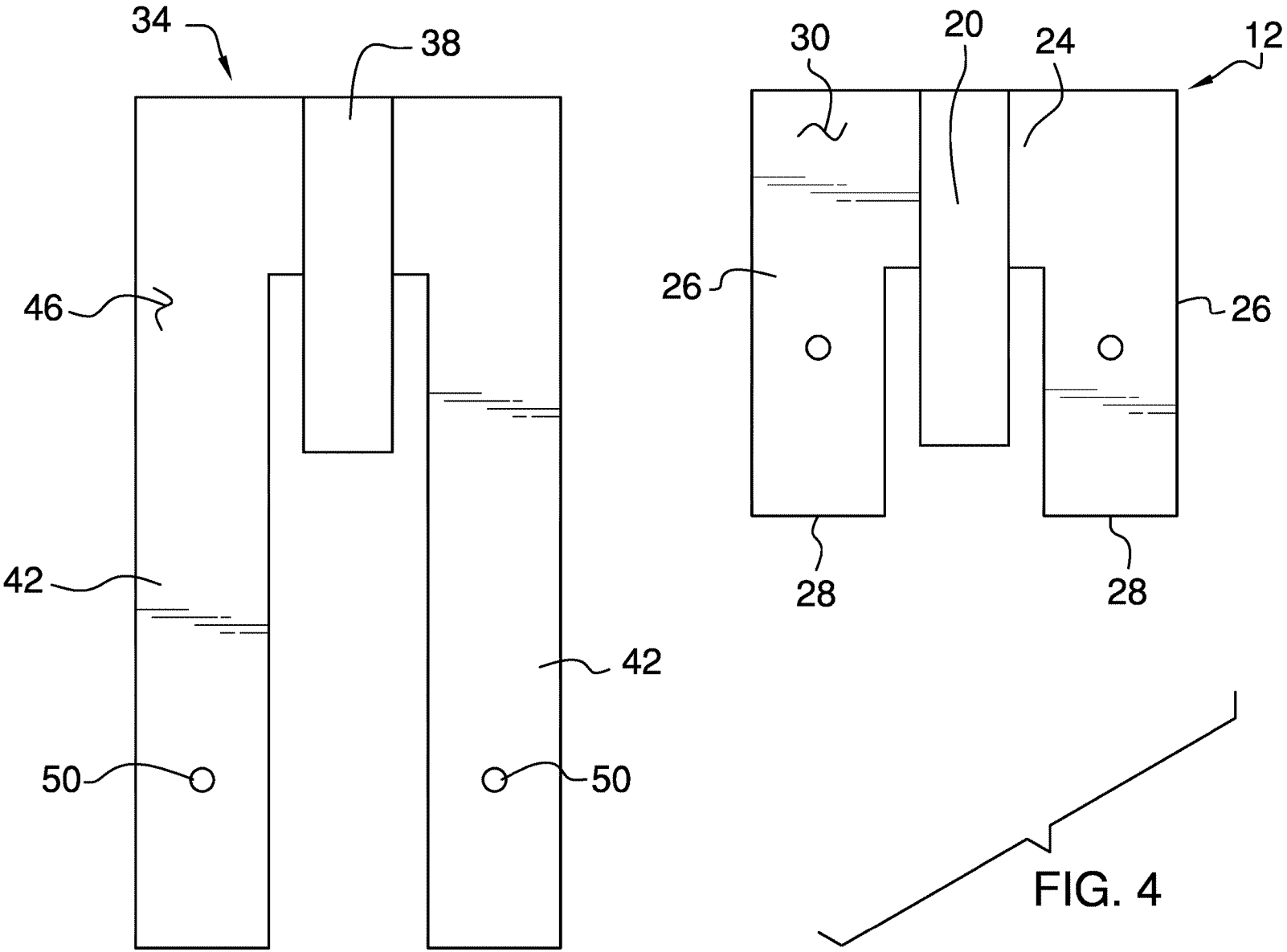
FIG. 4 is a top view of an embodiment of the disclosure.
Figure 5:
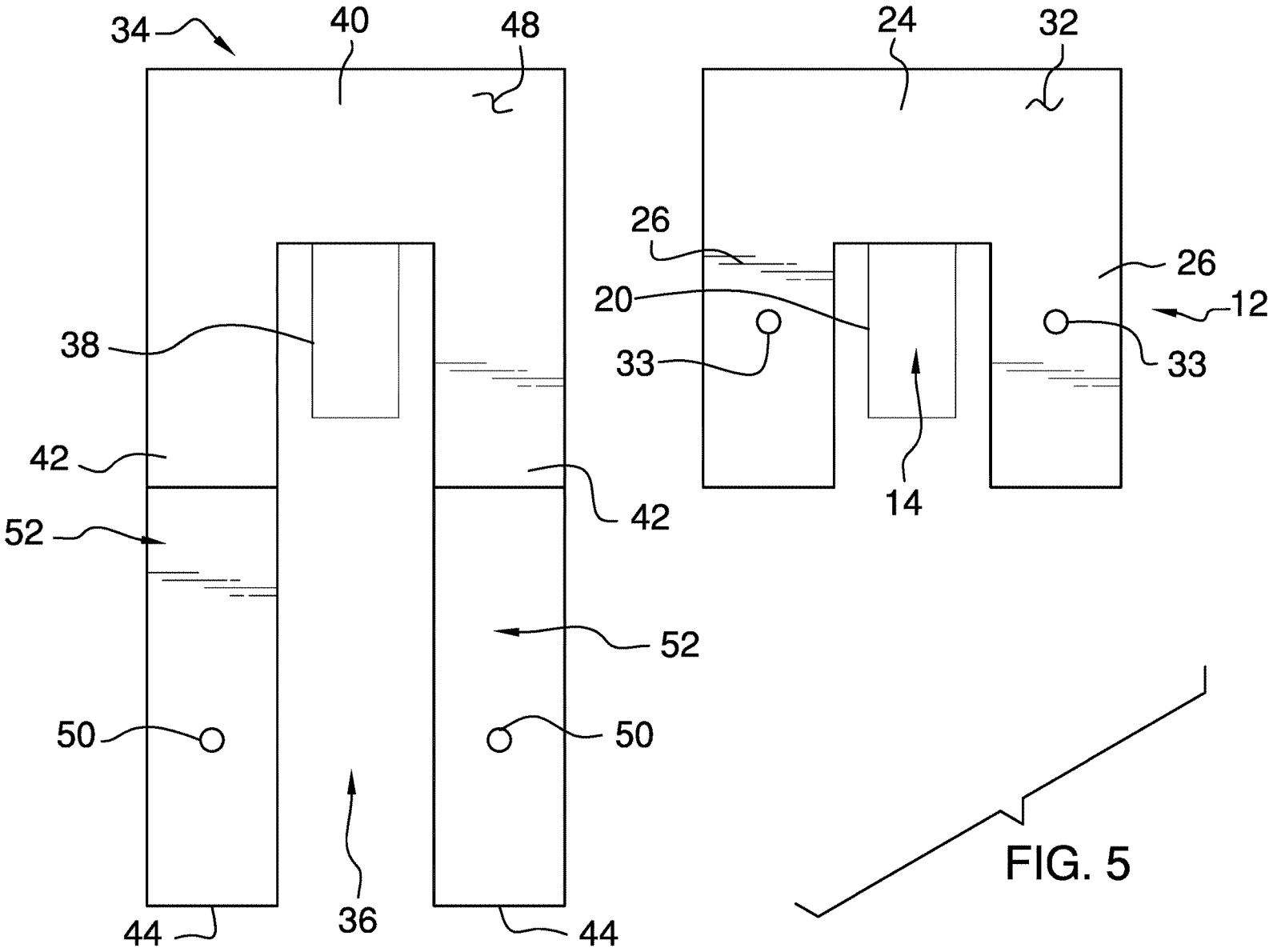
FIG. 5 is a bottom view of an embodiment of the disclosure.
Figure 6:
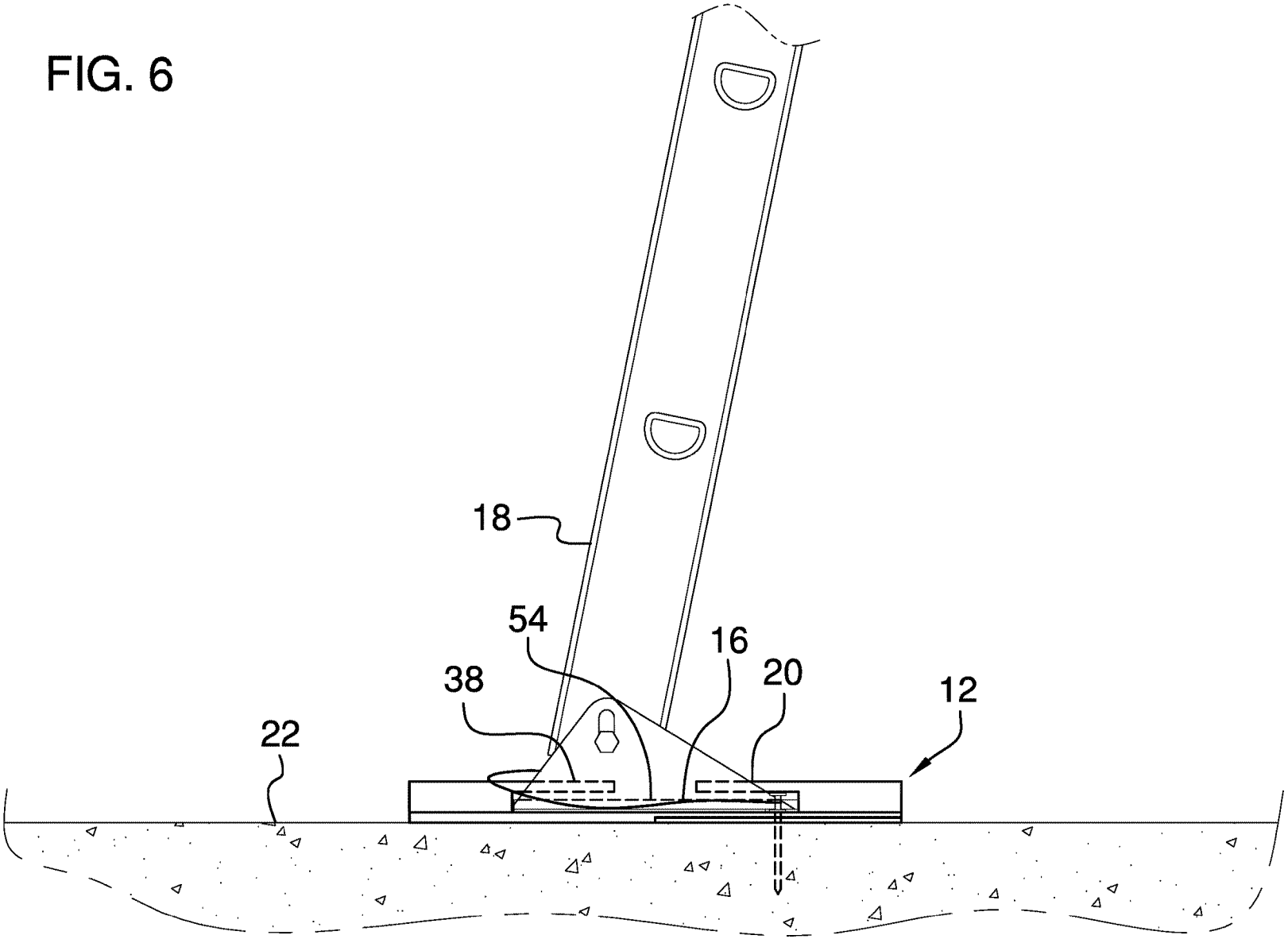
FIG. 6 is a perspective in-use view of an embodiment of the disclosure.

With reference now to the drawings, and in particular to FIGS. 1 through 6 thereof, a new anchoring device embodying the principles and concepts of an embodiment of the disclosure and generally designated by the reference numeral 10 will be described.

As best illustrated in FIGS. 1 through 6, the ladder anchoring assembly 10 generally comprises a first mount 12 that has a first space 14 for insertably receiving a foot 16 of a ladder 18. The first mount 12 includes a first engagement 20 for engaging the foot 16 of the ladder 18. The ladder 18 may be an extension ladder such as would commonly be found on a construction site. The first mount 12 is attachable to a support surface 22 upon which the foot 16 of the ladder 18 is positioned. The support surface 22 may be a concrete slab, the ground or any other horizontal support surface.

The first mount 12 comprises a central section 24 extending between pair of first feet 26. Each of the first feet 26 has a distal end 28 with respect to the central section 24. The first feet 26 are spaced apart from each other to define the first space 14 between the first feet 26. The first mount 12 has a top surface 30 and a bottom surface 32, and the first mount 12 has a pair of fastener apertures 33 each extending through the top surface 30 and the bottom surface 32. Each of the fastener apertures 33 is positioned on a respective one of the first feet 26.

The first engagement 20 is positioned on the top surface 30 corresponding to the central section 24. Additionally, the first engagement 20 is aligned with the first space 14. The first engagement 20 is oriented collinear with each of the first feet 26. The first engagement 20 is spaced upwardly from each of the first feet 26.

A second mount 34 is provided and that second mount 34 has a second space 36 therein for insertably receiving the foot 16 of the ladder 18. The second mount 34 includes a second engagement 38 for engaging the foot 16 of the ladder 18. The second mount 34 is attachable to the support surface 22 having the second mount 34 being directed toward the first mount 12. In this way each of the first mount 12 and the second mount 34 surrounds the foot 16 of ladder 18. Thus, the first mount 12 and the second mount 34 restrain the foot 16 of the ladder 18 on the support surface 22.

The second mount 34 comprises a middle section 40 extending between pair of second feet 42. Each of the second feet 42 has a distal end 44 with respect to the middle section 40. The second feet 42 are spaced apart from each other to define the second space 36 between the second feet 42. The second mount 34 has a top surface 46 and a bottom surface 48. Additionally, the second mount 34 has a pair of fastener apertures 50 each extending through the top surface 46 and the bottom surface 48 of the second mount 34. Each of the fastener apertures 50 is positioned on a respective one of the second feet 42.

The second engagement 38 is positioned on the top surface 46 corresponding to the middle section 40 and the second engagement 38 is aligned with the second space 36. The second engagement 38 is oriented collinear with each of the second feet 42. Additionally, the second engagement 38 is spaced upwardly from each of the second feet 42. The bottom surface 48 of each of the second feet 42 has a recess 52 therein and the recess 52 on the bottom surface 48 of each of the second feet 42 extends from the distal end 44 of the second feet 42 toward the middle section 40. Each of the first feet 26 on the first mount 12 are positioned in the recess 52 in a respective one of the second feet 42 has the first engagement 20 being directed toward the second engagement 38. Additionally, each of the fastener apertures 50 in the second feet 42 are aligned with a respective one of the fastener apertures 33 in the first feet 26.

In use, the ladder 18 is positioned at a selected position on the support surface 22 and the first mount 12 is slid around a respective foot 16 on the ladder 18 such that the first engagement 20 slides over a top side 54 of the respective foot 16. The second mount 34 is lid around the respective foot 16 from the opposite direction from the first mount 12. Thus the second engagement 38 slides over the top side 54 of the respective foot 16. A plurality of fasteners, such as screws or bolts, is each extended through respective ones of the fastener apertures 33, 50 for fastening each of the first mount 12 and the second mount 34 to the support surface 22. In this way the foot 16 of the ladder 18 is restrained on the support surface 22 thereby enhancing safety for a user that is using the ladder 18. A plurality of the first mounts 12 and a plurality of the second mounts 34 are provided for fastening each of the feet 16 of the ladder 18 to the support surface 22.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A ladder anchoring assembly being configured to secure feet of a ladder to a support surface, said assembly comprising:

a first mount having a first space for insertably receiving a foot of a ladder and a first engagement for engaging the foot of the ladder, said first mount being attachable to a support surface upon which the foot of the ladder is positioned, wherein said first mount comprises a central section extending between pair of first feet, each of said first feet having a distal end with respect to said central section, said first feet being spaced apart from each other to define said first space between said first feet, and a top surface and a bottom surface, said first mount having a pair of fastener apertures each extending through said top surface and said bottom surface, each of said fastener apertures being positioned on a respective one of said first feet;

wherein said first engagement is positioned on said top surface corresponding to said central section, said first engagement being aligned with said first space, said first engagement being oriented parallel with each of said first feet, said first engagement being spaced upwardly from each of said first feet; and a second mount having a second space therein for insertably receiving the foot of the ladder and a second engagement for engaging the foot of the ladder, said second mount being attachable to the support surface having said second mount being directed toward said first mount such that each of said first mount and said second mount surrounds the foot of ladder wherein said first mount and said second mount are configured to restrain the foot of the ladder on the support surface.

2. The assembly according to claim 1, wherein said second mount comprises a middle section extending between pair of second feet, each of said second feet having a distal end with respect to said middle section, said second feet being spaced apart from each other to define said second space between said second feet.

3. The assembly according to claim 2, wherein said second mount has a top surface and a bottom surface, said second mount having a pair of fastener apertures each extending through said top surface and said bottom surface of said second mount, each of said fastener apertures being positioned on a respective one of said second feet.

4. A ladder anchoring assembly being configured to secure feet of a ladder to a support surface, said assembly comprising:

a first mount having a first space for insertably receiving a foot of a ladder and a first engagement for engaging the foot of the ladder, said first mount being attachable to a support surface upon which the foot of the ladder is positioned; and wherein said first mount comprises a central section extending between pair of first feet, each of said first feet having a distal end with respect to said central section, said first feet being spaced apart from each other to define said first space between said first feet;

a second mount having a second space therein for insertably receiving the foot of the ladder and a second engagement for engaging the foot of the ladder, said second mount being attachable to the support surface having said second mount being directed toward said first mount such that each of said first mount and said second mount surrounds the foot of ladder wherein said first mount and said second mount are configured to restrain the foot of the ladder on the support surface;

wherein said second mount comprises a middle section extending between pair of second feet, each of said second feet having a distal end with respect to said middle section, said second feet being spaced apart from each other to define said second space between said second feet;

wherein said second mount has a top surface and a bottom surface, said second mount having a pair of fastener apertures each extending through said top surface and said bottom surface of said second mount, each of said fastener apertures being positioned on a respective one of said second feet; and wherein said second engagement is positioned on said top surface corresponding to said middle section, said second engagement being aligned with said second space, said second engagement being oriented parallel with each of said second feet, said second engagement being spaced upwardly from each of said second feet.

5. The assembly according to claim 4, wherein said bottom surface of each of said second feet has a recess therein, said recess on the bottom surface of each of said second feet extending from said distal end of said second feet toward said middle section, each of said first feet being positioned in said recess in a respective one of said second feet having said first engagement being directed toward said second engagement.

6. A ladder anchoring assembly being configured to secure feet of a ladder to a support surface, said assembly comprising:

a first mount having a first space for insertably receiving a foot of a ladder and a first engagement for engaging the foot of the ladder, said first mount being attachable to a support surface upon which the foot of the ladder is positioned, said first mount comprising a central section extending between pair of first feet, each of said first feet having a distal end with respect to said central section, said first feet being spaced apart from each other to define said first space between said first feet, said first mount having a top surface and a bottom surface, said first mount having a pair of fastener apertures each extending through said top surface and said bottom surface, each of said fastener apertures being positioned on a respective one of said first feet, said first engagement being positioned on said top surface corresponding to said central section, said first engagement being aligned with said first space, said first engagement being oriented parallel with each of said first feet, said first engagement being spaced upwardly from each of said first feet; and a second mount having a second space therein for insertably receiving the foot of the ladder and a second engagement for engaging the foot of the ladder, said second mount being attachable to the support surface having said second mount being directed toward said first mount such that each of said first mount and said second mount surrounds the foot of ladder wherein said first mount and said second mount are configured to restrain the foot of the ladder on the support surface, said second mount comprising a middle section extending between pair of second feet, each of said second feet having a distal end with respect to said middle section, said second feet being spaced apart from each other to define said second space between said second feet, said second mount having a top surface and a bottom surface, said second mount having a pair of fastener apertures each extending through said top surface and said bottom surface of said second mount, each of said fastener apertures being positioned on a respective one of said second feet, said second engagement being positioned on said top surface corresponding to said middle section, said second engagement being aligned with said second space, said second engagement being oriented parallel with each of said second feet, said second engagement being spaced upwardly from each of said second feet, said bottom surface of each of said second feet having a recess therein, said recess on the bottom surface of each of said second feet extending from said distal end of said second feet toward said middle section, each of said first feet being positioned in said recess in a respective one of said second feet having said first engagement being directed toward said second engagement.

* * * * *